US006289079B1

(12) United States Patent
Chornenky et al.

(10) Patent No.: US 6,289,079 B1
(45) Date of Patent: Sep. 11, 2001

(54) X-RAY DEVICE AND DEPOSITION PROCESS FOR MANUFACTURE

(75) Inventors: Victor Ivan Chornenky, Minnetonka; Ali Jaafar, Eden Prairie; Graham Steven Kerslick, Minneapolis, all of MN (US)

(73) Assignee: Medtronic AVE, Inc., Santa Rosa, CA (US)

( * ) Notice: Subject to any disclaimer, the term of this patent is extended or adjusted under 35 U.S.C. 154(b) by 0 days.

(21) Appl. No.: 09/274,509

(22) Filed: Mar. 23, 1999

(51) Int. Cl.[7] ..... H01J 35/08
(52) U.S. Cl. ..... 378/143; 378/119; 378/65
(58) Field of Search ..... 378/143, 119, 378/65, 121; 313/542

(56) References Cited

U.S. PATENT DOCUMENTS

| | | |
|---|---|---|
| Re. 34,421 | 10/1993 | Parker et al. . |
| 1,881,448 | 10/1932 | Forde et al. . |
| 2,173,258 | 9/1939 | Lederer . |
| 3,508,059 | 4/1970 | Vanderpool . |
| 3,582,702 | 6/1971 | Almer . |
| 3,691,417 | 9/1972 | Gralenski . |
| 3,714,486 | 1/1973 | McCrary . |
| 3,883,760 | 5/1975 | Cunningham, Jr. . |
| 3,920,999 | 11/1975 | Drexler et al. . |
| 4,104,526 | 8/1978 | Albert . |
| 4,163,901 | 8/1979 | Azam et al. . |
| 4,164,680 | 8/1979 | Villalobos . |
| 4,359,660 | 11/1982 | Smith et al. . |
| 4,789,997 | 12/1988 | Madsen et al. . |
| 4,800,581 | 1/1989 | Kujirai et al. . |
| 4,924,485 | 5/1990 | Hoeberling . |
| 4,979,199 | 12/1990 | Cueman et al. . |
| 4,987,007 | 1/1991 | Wagal et al. . |
| 5,077,771 | 12/1991 | Skillicorn et al. . |
| 5,090,043 | 2/1992 | Parker et al. . |
| 5,098,737 | 3/1992 | Collins et al. . |
| 5,148,463 | 9/1992 | Woodruff et al. . |
| 5,153,900 | 10/1992 | Nomikos et al. . |
| 5,165,093 | 11/1992 | Miller et al. . |
| 5,199,939 | 4/1993 | Dake et al. . |
| 5,222,116 | 6/1993 | Eloff et al. . |
| 5,228,176 | 7/1993 | Bui et al. . |

(List continued on next page.)

FOREIGN PATENT DOCUMENTS

| | | |
|---|---|---|
| 2054738 | 5/1972 | (DE) . |
| 2608418 A1 | 9/1977 | (DE) . |
| 0 359 724 A2 | 3/1990 | (EP) . |

(List continued on next page.)

OTHER PUBLICATIONS

Anthony, T.R., "Cylindrically Symmetric Diamond Parts by Hot–Filament CVD", *Diamond and Related Materials*, vol. 6, pp. 1707–1715 (1997).
Borghi, Dr. M., "ST 121 and ST 122 Porous Coating Getters", *SAES Getters S.p.A.*, pp. 1–13 (Jul. 27, 1994).
Brandes, G., "Diamond Vacuum Electronics", (Source unknown), Chapter 17, pp. 1–27 (Date unknown).
Catalog pages displaying Dunlee DL–1 through Dunlee DL–7 Stationary Anode Inserts and Rating Charts, 16 pgs. (Jun. 1972).

(List continued on next page.)

*Primary Examiner*—Robert H. Kim
*Assistant Examiner*—Pamela R. Hobden

(57) ABSTRACT

A method of manufacturing an X-ray device is described including the step of coupling a housing that includes diamond to an anode structure that includes diamond. Further, a target metal may be formed on a tip of the anode structure. An X-ray device is also described including a housing made of diamond, a cathode within the housing, and an anode structure that includes diamond. The anode structure may include conductive diamond, while the housing structure may include high resistivity diamond.

13 Claims, 4 Drawing Sheets

U.S. PATENT DOCUMENTS

| | | | |
|---|---|---|---|
| 5,342,283 | 8/1994 | Good . | |
| 5,369,679 | 11/1994 | Sliski et al. . | |
| 5,414,748 | 5/1995 | Upadhya . | |
| 5,422,926 | 6/1995 | Smith et al. . | |
| 5,428,658 | 6/1995 | Oettinger et al. . | |
| 5,437,277 | 8/1995 | Dumoulin et al. . | |
| 5,442,678 | 8/1995 | Dinsmore et al. . | |
| 5,452,720 | 9/1995 | Smith et al. . | |
| 5,469,490 | 11/1995 | Golden et al. . | |
| 5,503,613 | 4/1996 | Weinberger . | |
| 5,509,045 | 4/1996 | Kautz . | |
| 5,511,107 | 4/1996 | Sliski . | |
| 5,528,652 | 6/1996 | Smith et al. . | |
| 5,566,221 | 10/1996 | Smith et al. . | |
| 5,621,780 | 4/1997 | Smith et al.. . | |
| 5,631,046 | 5/1997 | Boudreaux et al. . | |
| 5,729,583 | 3/1998 | Tang et al. . | |
| 5,748,699 | 5/1998 | Smith . | |
| 5,854,822 | 12/1998 | Chornenky et al. . | |
| 5,982,094 * | 11/1999 | Niigaki et al. | 313/542 |
| 6,108,402 * | 8/2000 | Chornenky | 378/19 |

FOREIGN PATENT DOCUMENTS

| | | |
|---|---|---|
| 0 359 724 A3 | 3/1990 | (EP) . |
| 0 572 170 A1 | 12/1993 | (EP) . |
| 0 697 712 A1 | 2/1996 | (EP) . |
| 0 718 864 A1 | 6/1996 | (EP) . |
| 0 860 180 A2 | 8/1998 | (EP) . |
| 0 860 181 A2 | 8/1998 | (EP) . |
| 230183 | 3/1925 | (GB) . |
| 997352 | 7/1965 | (GB) . |
| 58-145098 | 8/1983 | (JP) . |
| 08153460 | 6/1996 | (JP) . |
| 814331 | 3/1981 | (SU) . |
| WO 95/20241 | 7/1995 | (WO) . |
| WO 96/02059 | 1/1996 | (WO) . |
| WO 97/06549 | 2/1997 | (WO) . |
| WO 97/07740 | 3/1997 | (WO) . |
| WO 99/36938 | 7/1999 | (WO) . |

OTHER PUBLICATIONS

Choi, W.B. et al., "Field Emission from Diamond Coated Molybdenum Field Emitters", *J. Vac. Sci. Technol. B*, vol. 14, No. 3, pp. 2050–2055 (May/Jun. 1996).

Chornenky, V., "Intravascular Soft X–Ray Therapy", *Vascular Brachytheraphy*, Second Edition, pp. 561–567 (1999).

Chornenky, V., "The Soft X–Ray System", *Handbook of Vascular Brachytherapy*, 6 pgs. (1998).

Collins, C.B. et al., "Laser Plasma Source of Amorphic Diamond", *Appl. Phys. Lett.*, vol. 54, No. 3, pp. 216–218 (Jan. 16, 1989).

Davanloo, F. et al., "Amorphic Diamond Films Produced by a Laser Plasma Source", *J. Appl. Phys.*, vol. 67, No. 4, pp. 2081–2087 (Feb. 15, 1990).

della Porta, Dr. P., "Gettering' an Integral Part of Vacuum Technology", *American Vacuum Society 39th National Symposium*, Technical Paper TP 202, 15 pgs. (Nov. 9–13, 1992).

"Diamond Surface Emission Cathodes", http://www.chm-.bris.ac.uk/pt/diamond/devices.htm, 3 pgs. (Nov. 6, 1998).

"Diamond Field Emission Devices", http://www.chm.bris.ac.uk/pt/diamond/feds.htm, 1 pg. (Nov. 6, 1998).

Geis, M.W. et al., "Diamond Emitters Fabrication and Theory", *J. Vac. Sci. Technol. B*, vol. 14, No. 3, pp. 2060–2067 (May/Jun. 1996).

Giorgi, T.A., "Getters and Gettering", *Japan J. Appl. Phys. Suppl. 2*, Pt. 1, pp. 53–60 (1974).

Giorgi, E. et al., "High Porosity Thick Film Getters", *SAES Getters S.p.A.*, pp. 1–20 (Date unknown).

Givargizov, E.I. et al., "Cold Emission from the Single–Crystalline Microparticle of Diamond on a Si Tip", *J. Vac. Sci. Technol. B*, vol. 14, No. 3, pp. 2030–2033 (May/Jun. 1996).

Givargizov, E.I. et al., "Growth of Diamond Particles on Sharpened Silicon Tips", *Materials Letters*, vol. 18, pp. 61–63 (1993).

Givargizov, E.I., "Silicon Tips with Diamond Particles on Them: New Field Emitters?", *J. Vac. Sci. Technol. B*, vol. 13, No. 2, pp. 414–417 (Mar./Apr. 1995).

Himpsel, F.J. et al., "Quantum Photoyield of Diamond (111)—A Stable Negative–Affinity Emitter", *Physical Review B*, vol. 20, No. 2, pp. 624–627 (Jul. 15, 1979).

Kitahama, K. et al., "Synthesis of Diamond by Laser–Induced Chemical Vapor Deposition", *Appl. Phys. Lett.*, vol. 49, No. 11, pp. 634–635 (Sep. 15, 1986).

Kumar, N. et al., "Diamond–Based Field Emission Flat Panel Displays", *Solid State Technology*, pp. 71–74 (May 1995).

Landstrass, M.I. et al., "Resistivity of Chemical Vapor Deposited Diamond Films", *Appl. Phys. Lett.*, vol. 55, No. 10, pp. 975–977 (Sep. 4, 1989).

Latham, R.V. (editor), "High Voltage Vacuum Insulation—Basic Concepts and Technological Practice", pp. 32–39 (Date unknown).

Liu, J. et al., "Field Emission Characteristics of Diamond Coated Silicon Field Emitters", *J. Vac. Sci. Technol. B*, vol. 13, No. 2, pp. 422–426 (Mar./Apr. 1995).

Meigooni, A. et al., "Basic Physics of Brachytherapy", *Principles and Practice of Brachytherapy*, Chapter 4, pp. 47–64 (1997).

Okano, K. et al., "Electron Emission from Phosphorous and Boron–Doped Polycrystalline Diamond Films", *Electronic Letters*, vol. 31, No. 1, pp. 74–75 (Jan. 5, 1995).

Pupeter, N. et al., "Field Emission Measurements with $\mu$m Resolution on Chemical–Vapor–Deposited Polycrystalline Diamond Films", *J. Vac. Sci. Technol. B*, vol. 14, No. 3, pp. 2056–2059 (May/Jun. 1996).

Sato, T. et al., "Deposition of Diamond–Like Carbon Films by Pulsed–Laser Evaporation", *Japanese Journal of Applied Physics*, vol. 26, No. 9, pp. L1487–L1488 (Sep. 1987).

Wagal, S.S. et al., "Diamond–Like Carbon Films Prepared with a Laser Ion Source", *Appl. Phys. Lett.*, vol. 53, No. 3, pp. 187–188 (Jul. 18, 1988).

Wang, C. et al., "Cold Field Emission from CVD Diamond Films Observed in Emission Electron Microscopy", *Electronic Letters*, vol. 27, No. 16, pp. 1459–1461 (Aug. 1, 1991).

Xle, C. et al., "Electron Field Emission from Amorphic Diamond Thin Films", (Source unknown), pp. 162–163, (Date unknown).

Xu, N.S. et al., "Rapid Communication—A Diagnostic Study of the Field Emission Characteristics of Individual Micro–Emitters in CVD Diamond Films", *J. Phys. D: Appl. Phys.*, vol. 27, pp. 1988–1991 (1994).

Zhirnov, V.V. et al., "Emission Stability and High Current Performance of Diamond–Coated Si Emitters", *J. Vac. Sci. Technol. B*, vol. 14, No. 3, pp. 2034–2036 (May/Jun. 1996).

* cited by examiner

FIG. 1
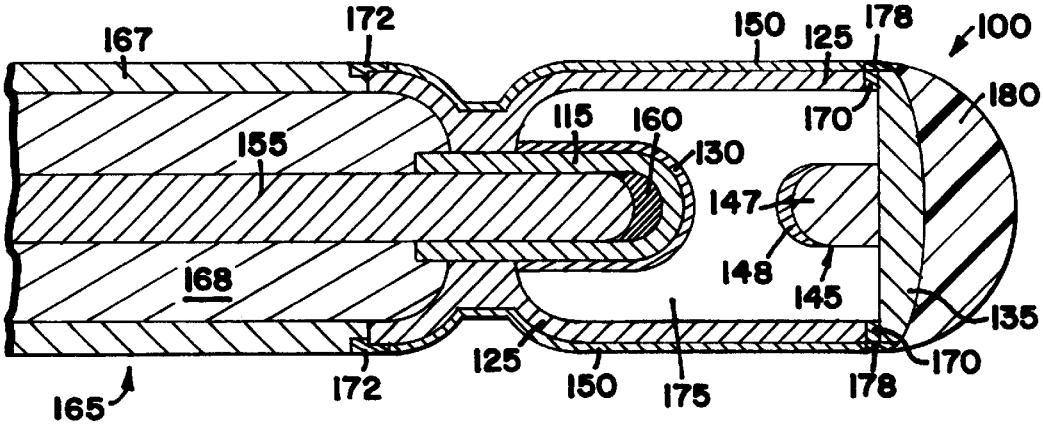
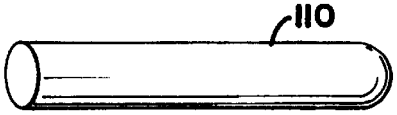
FIG. 2
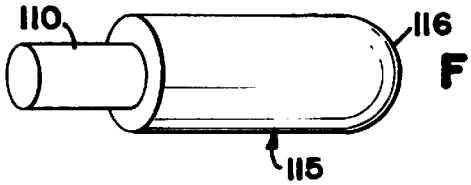
FIG. 3
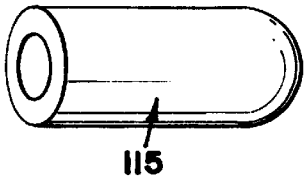
FIG. 4
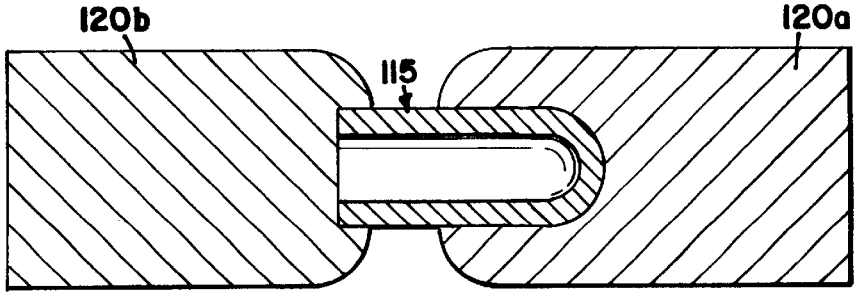
FIG. 5

FIG. 10
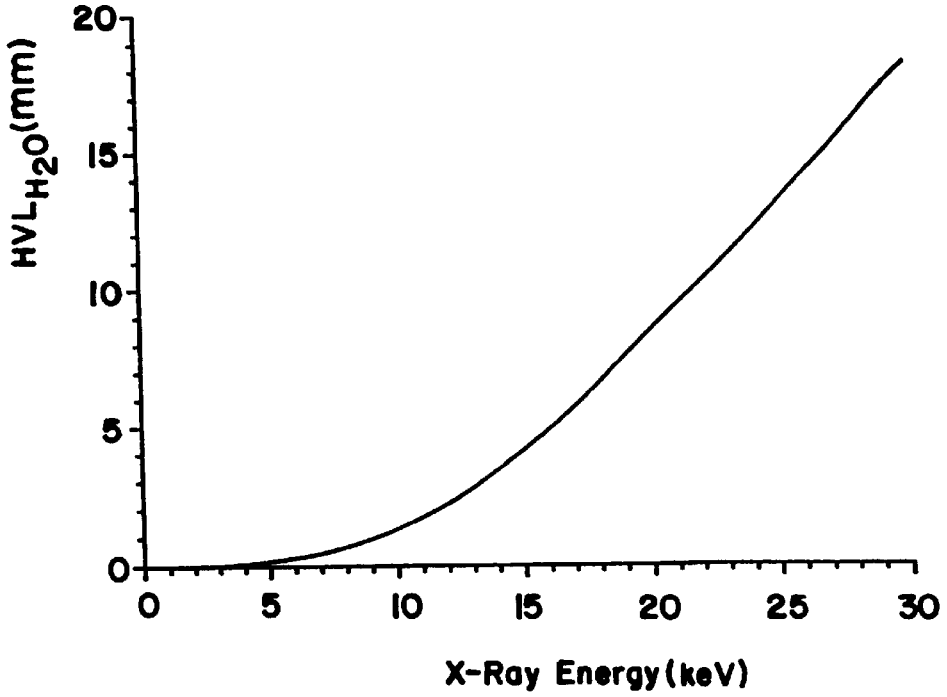
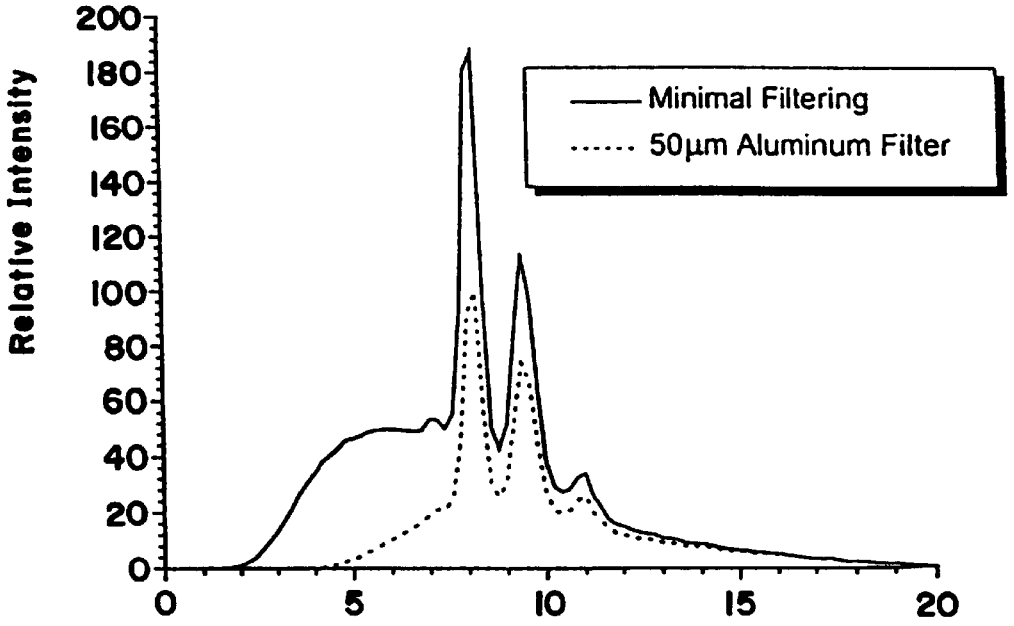
FIG. 9

X-RAY DEVICE AND DEPOSITION PROCESS FOR MANUFACTURE

FIELD OF THE INVENTION

The present invention is directed generally to a method of manufacturing an X-ray emitter and, more particularly, to a method of forming an X-ray emitter having a diamond anode and a diamond housing.

BACKGROUND OF THE INVENTION

In the medical field, doctors and scientists are striving to find less invasive ways to treat patients. By using treatments that are less intrusive to the body, doctors can greatly reduce the stress on the patient's system and exposure to infection. For example, laparoscopic techniques enable physicians to explore the interior of the body and perform surgery through a small opening in the skin. Less intrusive medical techniques are extremely beneficial when applied to cardiovascular diseases, for example.

Cardiovascular diseases affect millions of people, frequently causing heart attacks and death. One common aspect of many cardiovascular diseases is stenosis, or the thickening of the artery or vein, which decreases blood flow through the vessels. Angioplasty procedures have been developed to reopen clogged arteries without resorting to a bypass operation. However, in a large percentage of cases, arteries become occluded again after an angioplasty procedure. This recurrent decrease of the inner diameter of the vessel is termed restenosis. Restenosis frequently requires a second angioplasty and eventual bypass surgery. Bypass surgery is very stressful on a patient, requiring the chest to be opened, and presents risks from infection, anesthesia, and heart failure. Effective methods of preventing or treating restenosis could benefit millions of people.

One treatment for restenosis that has been attempted is radiation of the vessel wall. For example, U.S. patent application Ser. No. 08/701,764, filed Aug. 22, 1996, titled "X-ray Catheter," describes an X-ray device for insertion into a lumen of a body, capable of localized X-ray radiation. U.S. application Ser. No. 08/701,764 is hereby incorporated by reference in its entirety. There are many difficult technical issues associated with delivering localized X-ray radiation to the interior of a patient's lumen. U.S. Pat. No. 5,854,822, titled "Miniature X-ray Device Having Cold Cathode" discusses improved cathode configurations that improve the rate of electron emission and decrease the required electric field. U.S. Pat. No. 5,854,822 is incorporated herein by reference in its entirety.

There is a need for effective devices to be used to treat the interior of the body with minimal intrusion. Effective, less invasive techniques for preventing and treating stenosis and restenosis at a lumen wall are especially needed. Size improvements on an X-ray device reduce the size of the required incision, improve maneuverability, decrease the stress on the lumen, and enable the device to reach more remote locations in the patient's body. Other applications for localized X-ray radiation are numerous, such as treating the interior of the esophagus, and providing radiation to tumors. Further, numerous non-medical applications require miniature x-ray devices that operate effectively, simplify manufacturing, and minimize the required voltage. For example, investigation of very small spaces can be performed using localized x-ray radiation.

SUMMARY OF THE INVENTION

Generally, the present invention relates to an x-ray emitter and a method for manufacturing an X-ray emitter. In one embodiment of the invention, a method of fabricating an X-ray emitter includes the steps of coupling a diamond housing to a diamond anode structure. The housing may include a diamond material that has a high resistivity while the anode structure may comprise conductive diamond, in one alternative. The method may further include forming a target metal on the anode structure. In one embodiment, the target metal may have characteristic X-ray emission of at least 11 kiloelectron volts.

In another embodiment of the invention, a device for producing X-ray radiation includes a diamond housing, a cathode disposed within the housing, and a diamond anode structure, the anode structure coupled to the housing and the device arranged to enable the production of X-ray radiation. The device may include a target metal on a tip of the anode structure. The anode structure may include graphite in one alternative embodiment. The housing may further include an external metallic layer in one embodiment. Alternatively, an exterior layer of the housing may include diamond doped with boron to provide conductivity.

In yet another embodiment of the invention, a component for an X-ray emitter is described that includes a diamond housing coupled to a diamond anode structure.

The above summary of the present invention is not intended to describe each embodiment or every implementation of the present invention. The figures and the detailed description which follow more particularly exemplify these embodiment

BRIEF DESCRIPTION OF THE DRAWINGS

The invention may be more completely understood in consideration of the following detailed description of various embodiments of the invention in connection with the accompanying drawings, in which:

FIG. 1 shows a cross-sectional view of an X-ray device of the present invention.

FIG. 2 shows a side view of a primary mandrel.

FIG. 3 shows a side view of conductive anode structure formed on a primary mandrel.

FIG. 4 shows a side view of the isolated anode structure.

FIG. 5 shows a cross-sectional side view of a secondary mandrel that covers portions of the anode structure.

FIG. 9 shows a typical X-ray spectrum composed of Bremsstrahlung radiation and characteristic radiation.

FIG. 10 shows the relationship between the half value layer and energy for monoenergetic X-rays.

Figure 6:
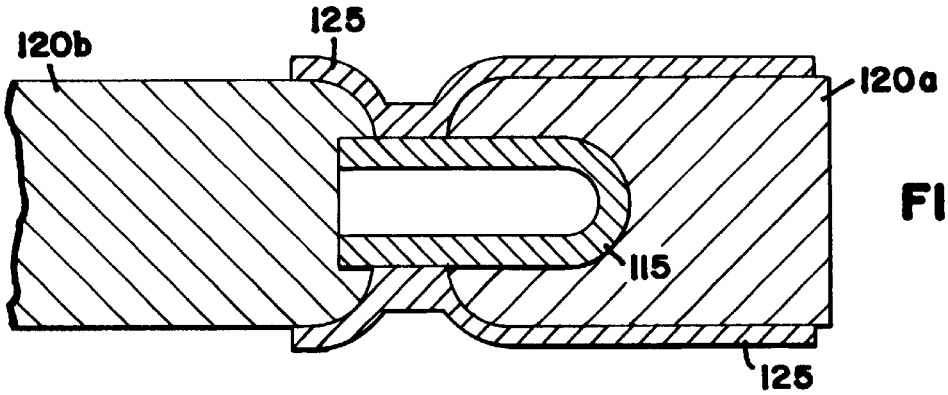
FIG. 6 illustrates a cross-sectional view of a diamond housing formed on the anode structure and secondary mandrel.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE VARIOUS EMBODIMENTS

The present invention is believed to be applicable to a variety of devices, methods of fabrication, methods of use, systems and arrangements that irradiate X-ray radiation. The invention is particularly advantageous for irradiating small, difficult to reach locations. For example, the present application is useful for irradiating lumens, vessels, or interior sites in a body using X-ray emitters to prevent restenosis in the cardiovascular system. While the present invention is not so limited, an appreciation of various aspects of the invention will be gained through a discussion of the fabrication process and characteristics of such a device in connection with the examples provided below.

Generally, the present invention provides an improved X-ray emitter, particularly an X-ray emitter that is designed for use inside a patient's body, especially a cardiovascular system. The method and device of the present invention produce a housing-to-anode connection that maintains a vacuum chamber despite temperatures changes. By using similar materials for both the housing and the anode base of the present invention, and by bonding the housing and anode base directly to each other, the x-ray emitter of the present invention is capable of maintaining mechanical integrity despite extreme temperature changes. The present invention may also reduce the number of voids and spikes within an X-ray emitter that are capable of enhancing the electric field. Further, the present invention may result in a simplified manufacturing process.

The effect of localized x-ray radiation on living tissue will now be discussed, to aid in understanding one application of the present invention. As X-ray radiation penetrates into the wall of the lumen or cavity, the radiation damages the DNA of a majority of smooth muscle cells. As the population of undamaged smooth muscle cells is depleted, their proliferation rate during the healing process after an angioplasty procedure is inhibited, and the consequent restentosis is less likely to occur. In coronary applications, it is desirable to have the X-ray radiation penetrate into the adventitia tissue of the blood-vessel about 1–2 millimeters deep from the inner vessel wall. Penetration into the cardiac muscle tissue should probably be minimized, although differences of opinion exist within the medical field. It is further desirable to deliver X-ray radiation with a peak energy of about 8–12 kiloelectronvolts (keV) in coronary applications. When the desired dosage has been delivered, the voltage source is discontinued and the X-ray device is withdrawn from the body.

X-ray emitters, particularly those that are miniature, require materials with particular specification requirements for safe and effective operation within a body. Other application environments also require miniature X-ray emitters that operate without electrical or mechanical failure. Diamond, because of its mechanical, electrical and chemical properties, is useful in miniature x-ray emitters, meeting the requirements for manufacturing the housing and the anode.

For example, for use in the body, the total diameter of the X-ray emitter should be small enough to readily pass through human arteries. The components of the X-ray emitter must be capable of construction at very small scales. Preferably, the total diameter should be about 1–4 millimeters. Also, since a vacuum chamber is enclosed by the housing in the X-ray device, the housing material used should be capable of heat-resistant, vacuum-tight connections with the metal components and the anode and cathode.

Diamond structures meet these mechanical requirements. Diamond structures are mechanically stronger than the boron nitride structures previously used for X-ray devices. Constructing the vacuum housing and the anode with diamond permits a significant size reduction.

The housing material should have high X-ray transparency. The housing surrounds the anode and cathode components, where the X-ray radiation is produced. X-ray transparent housing material allows full and reproducible dosages. Diamond, because of its low atomic number is highly transparent to X-ray radiation, allowing all clinically significant X-rays to exit the housing.

The material for the X-ray device also requires particular electrical properties. At certain points in the X-ray device, the high-potential lead that is connected to the anode is separated from the low-potential lead that is connected to the cathode by a distance of less than a millimeter. High potential differences are present within an X-ray emitter across very small distances. Electrical current from the anode to the cathode along an inner wall or through the inner wall of the housing should be prevented. The housing material of the X-ray emitter should have a high dielectric strength, in order to withstand a large electrical field without breakdown.

High resistivity is a desirable quality for the housing material to prevent leakage current through the housing. Preferably the housing has a resistivity of at least $1\times10^{11}$ ohm-cm. A bulk resistivity of $1\times10^{13}$ ohm centimeters or higher is more preferable.

Other qualities of the emitter may also contribute to prevent electrical breakdown, such as the geometry of the emitter, lack of gases and contaminants in the vacuum housing, resistivity, surface resistivity, and the dielectric constant, as is known in the art. One X-ray device designed for use inside the body is described in U.S. patent application Ser. No. 08/701,764, filed Aug. 22, 1996, titled "X-ray Catheter," which is hereby incorporated herein by reference in its entirety.

Current that leaks through the housing does not generate X-rays, so an accurate X-ray dose may not be administered if current leakages occur. In addition, leakage current through the housing will also generate undesirable heat. Considerable amounts of heat can also be produced within the X-ray unit. The heat causes thermal expansion of the components of the X-ray emitter, and particularly with materials with significantly different thermal expansion coefficients, the heat may cause mechanical failure, such as cracking and distortion.

Diamond is also an excellent heat conductor, with a thermal conductivity of about 20 Watts/cm K. Therefore, the heat generated by the X-ray emitter, for example, as a result of electron bombardment on the anode, will be dissipated throughout the structure quickly. Mechanical failure, such as cracking and structural distortion of the emitter, can also be restricted by forming the housing and the anode from diamond since the components will have similar thermal expansion coefficients.

A further advantage of including diamond in the vacuum housing is the electrical resistivity of diamond. The electrical resistivity of chemically vapor-deposited diamond is approximately $1\times10^{15}$ ohm-cm. The electric field at which diamond will experience electrical breakdown is about $1\times10^{7}$ V/cm. In order to maintain an electric field at the surface of the cathode, the anode and high voltage carrying components of the X-ray unit must be insulated from the conductive coating and external conductive layer of the coaxial cable. The potential of the external conductive layer is a floating low potential. The patient is grounded, as is known in the art and as is described in the "Handbook of Electrical Hazards and Accidents," edited by Leslie Geddes, published by CRC Press, Boca Raton, Fla., 1995, which is hereby incorporated herein by reference in its entirety. Insufficient insulation results in electrical discharge or failure. The use of diamond as the vacuum housing improves insulation and reduces the likelihood of electrical failure.

FIGS. 1–8 illustrate one exemplary embodiment of a process for fabricating an X-ray emitter designed for use inside a patient's body, particularly for the cardiovascular system. In particular, the housing and anode, both comprising diamond, are integrally coupled to reduce structural distortion due to heat exposure.

FIG. 1 illustrates a cross-section of one embodiment of an assembled x-ray device 100 of the present invention. Now referring to FIGS. 2–8, the assembly steps of the x-ray device 100 are described. A conductive anode 115 is formed on a primary mandrel 110, as shown in FIGS. 2 and 3. The shape of the mandrel 110, in part, determines the shape of the anode 115, which is typically tubular and/or shaped so as to form a tip 116. For example, the anode 115 may be a tapered cylinder with a rounded distal end, although many different shapes and other configurations for the anode 115 may be used and are contemplated by this invention. The mandrel 110 can be made of a variety of materials, for example, silicon, tantalum, molybdenum, tungsten, titanium, or other appropriate materials which do not react with diamond and are easily removed after forming the anode 115. The primary mandrel 110 may be removed, for example, by etching with an acid, such as hydrofluoric acid.

The anode 115 comprises conductive diamond. The electrical resistivity of the conductive diamond anode typically ranges from, for example, 0.01 to $1\times10^6$ ohm-cm. The length of the anode 115 can range, for example, from 0.5 to 1.5 mm. The thickness of the anode can range, for example, from 150 to 250 micrometers. Anodes of different sizes may be used, depending on the purpose of the device to be manufactured.

The anode 115 is typically formed by chemical vapor deposition (CVD) of diamond. Recent advances in chemical vapor deposition techniques have made possible the construction of three-dimensional diamond structures. Diamond structures can be grown by depositing diamond onto a metal rod or mandrel 110.

The material for the diamond anode is electrically conductive in order to establish the required electric field between the anode and the cathode. The conductive diamond anode 115 may be formed by doping the CVD plasma with for example, a boroncontaining compound, such as $B_2H_2$, or pure boron introduced into the deposition reactor. Atomic dopant boron/carbon concentrations in plasma typically range, for example, from 50 to 500 ppm. Thus, in accordance with this invention, it is possible to use a three-dimensional diamond shell as a structural element of the anode 115.

The most preferred methods of creating structural diamond parts are hot filament deposition, combustion, and direct current arc jets. These three types of chemical vapor deposition methods are described in the art and are generally known to those skilled in the art. For example, deposition of diamond tube shapes is well-described in "Cylindrically Symmetric Diamond Parts by Hot-Filament CVD," Diamond and Related Materials, Volume 6, pages 1707–1715 (1997), written by T. R. Anthony, which is incorporated herein by reference in its entirety. Chemical vapor deposition of diamond is also described, for example, in the book *Diamond Films and Coatings*, Editor Robert F. Davis, Noyes Publication, 1993, which is incorporated herein by reference in its entirety. CVD of diamond can be performed by General Electric and other manufacturers.

After forming the anode 115 on the mandrel 110, the anode 115 is isolated, as shown in FIG. 4. Typically, the mandrel 110 is removed by etching the mandrel 110 and the anode 115 assembly in an acid solution, such as hydrofluoric acid. Other methods for removing the mandrel 110 may also be used, as long as the removal methods do not adversely affect the anode 115. The isolated anode 115 may then be cut, for example, by laser, to the desired size and may be cleaned, for example, using sulfo-chromic, nitric or sulfuric acid, to remove contaminants.

The anode 115 is then prepared to be coupled to the housing 125. A secondary mandrel 120 is positioned on the anode 115, as shown in FIG. 5. The secondary mandrel 120, including two pieces 120*a* and 120*b*, is configured so as to selectively cover the anode 115, allowing the housing 125 to couple to the anode 115 and to define a vacuum chamber. Typically, the secondary mandrel parts 120*a* and 120*b* are cylindrical members with center portions removed to accommodate the anode 115. The secondary mandrel 120 can be made of a variety of materials, for example, silicon, tantalum, molybdenum, tungsten, titanium, or other appropriate materials which do not react with diamond and are easily removed after forming the housing 125, for example, by etching with an acid.

The housing 125 is formed, as shown in FIG. 6. The housing 125 is coupled to a portion of the anode 115 and defines, in part, the shape of the X-ray vacuum chamber. The housing 125 typically has a cylindrical or tubular shape, such that it can be inserted into a patient's body to deliver X-ray radiation, although other configurations are possible and contemplated by this invention. The length of the housing 125 can range, for example, from 3 to 10 millimeters. The thickness of the housing walls 125 can range, for example, from 150 to 300 microns. Different sizes of housings may be used depending on the purposes of the device to be manufactured. The housing is made of insulating diamond with electrical resistivity typically higher than $1\times10^{12}$ ohm-cm, for example.

The housing 125 is formed, typically, by chemical vapor deposition. Deposition of diamond is well-described in "Cylindrically Symmetric Diamond Parts by Hot-Filament CVD," Diamond and Related Materials, Volume 6, pages 1707–1715 (1997), written by T. R. Anthony, and in the book *Diamond Films and Coatings*, Editor Robert F. Davis, Noyes Publication, 1993, which were previously incorporated herein by reference in their entirety. CVD can be performed by General Electric and other manufacturers.

After the diamond housing 125 is formed, the housing 125 may be further treated. For example, the housing 125 may be annealed in air at a temperature of about 700° C. to 1000° C. for one-quarter to one hour in order to increase the electrical resistivity of the structure. The interior surface of the diamond housing 125 may also be treated in order to increase electrical resistivity of that surface. Etching of the inner surface with an acid, such as sulfo-chromic acid, increases the electrical resistivity and therefore helps reduce the risk of a short in the X-ray emitter due to a discharge between the high-potential anode and the cathode which is at a low potential. Heat treatment of diamond is described in M. I. Landstrass and K. V. Ravi, "Resistivity of Chemical Vapor Deposited Diamond Films," Applied Physics Letters, 55(10), Sep. 4, 1989, which is incorporated herein in its entirety.

Figure 7:
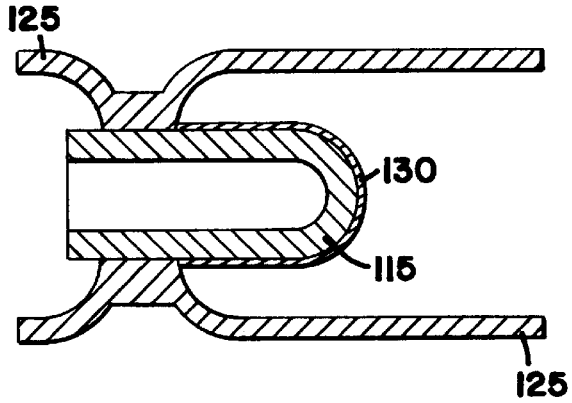
FIG. 7 shows a cross-sectional view of the isolated anode-housing assembly, with a target metal formed on the anode structure.

After the housing 125 is formed, the housing 125, coupled to the anode 115, is isolated by removing the secondary mandrel 120, as shown in FIG. 7. Typically, the secondary mandrel 120 is removed by etching in an acid such as hydrofluoric acid. The housing 125 may then be cut, for example, by laser, to a desired size.

The process of the present invention for fabricating the anode housing assembly 125 offers distinct differences and advantages compared to the prior art method of brazing the anode and the housing together. Both components, the conductive diamond of the anode 115 and the insulating diamond of the housing 125, have very similar thermal expansion coefficients, and thus, stress at the connection between the components caused by changes in temperature is reduced. Further, covalent diamond to diamond bonds can provide a mechanically strong, vacuum-tight joint. This assembly also minimizes voids or conductive sharp spikes that may be left in braze material, capable of enhancing the electrical field at the anode-housing interface or at the anode-vacuum-housing triple point to cause electrical breakdown. Further, a brazing procedure is difficult to perform because of the small size of the components. Diamond and the braze material have different thermal expansion coefficients, causing mechanical stress at the juncture between the diamond and the braze material as the temperature changes.

A target metal 130 is formed on a tip portion 116 of the anode 115, on the exterior surface which faces the vacuum chamber as shown in FIG. 7. The thickness of the target material can range, for example, from 0.5 to 1 micrometer. The target material 130 is typically formed from materials having the desired characteristic X-ray radiation.

When a high potential difference is applied across the anode and the cathode in the X-ray emitter, electrons emitted by the cathode are accelerated across the gap separating the anode and cathode. The electrons collide with the target metal of the anode, producing X-ray radiation. A typical X-ray spectrum is composed of two components, a continuum of Bremsstrahlung radiation extending from zero to a maximum energy, defined by the applied voltage, and sharp peaks of characteristic radiation. The Bremsstrahlung radiation is emitted by electrons decelerating as they impact the target material. The characteristic radiation is emitted by the atoms of the target material that are excited by collisions with electrons.

The characteristic radiation component of x-ray radiation has qualities that are determined by the nature of the atoms of the target, and can be modified only by changing the target material. The characteristic radiation consists of limited, discrete energies or wavelengths. The characteristic X-ray emission energies desired for cardiovascular applications may typically range from about eleven to about twenty-five kiloelectron volts, or, more preferably from about eleven to about nineteen kiloelectron volts. Additionally, depending on the tissue to be irradiated, such X-ray radiation typically has a depth of penetration with a half value layer of about two to about ten millimeters. The half value layer is defined as the thickness of the specified material which reduces the exposure rate from a source to one half of its initial value. Assuming that the irradiated material is uniform, characteristic X-ray radiation will have a half value layer that depends on the target material. Examples of typical target materials include strontium, yttrium, zirconium, niobium, and molybdenum. Preferably, yttrium may be used as the target material.

The target material 130 can be formed by a variety of techniques, preferably by electrodeposition. Other techniques, however, such as, laser deposition, chemical vapor deposition, and physical vapor deposition may be used and are known in the art. In electrodeposition, the anode-housing assembly 190 is placed in an electrolytic cell containing ions of the target metal to be deposited. Electrical current is applied such that the metal ions are reduced and metal deposition occurs at the exterior surface of the anode. Electropolishing can also be used to polish the surface of the target material. Typically, the electrical current is reversed for electropolishing. Electrodeposition is well-described in "Electrodeposition," Jack W. Dini, Noyes Publications, Park Ridge, N.J.

After forming the target material 130 on the tip portion 116 of the anode 115, the anode-housing assembly 190 is cleaned and heat treated. Typically, the assembly 190 is washed in distilled water and etched in acid, for example, hydrofluoric, nitric, or sulfuric acid, to remove possible metal contamination on the interior surface of the housing 125. The assembly 190 may be heat treated in a vacuum. The vacuum within the furnace is preferably maintained at about $1\times10^{-5}$ to $1\times10^{-7}$ millibars. The heat treatment within the vacuum furnace may be carried out at a temperature of 800° to 1000° Celsius for 15 to 30 minutes. Heat treating, among other purposes, promotes carbide formation between the diamond anode 115 and the target material 130, increases adhesion of the target material 130 to the anode 115, and removes residual hydrogen, among other gases, from the housing 125 to increase its resistivity. The diamond assembly 190 may then be used to manufacture the complete X-ray emitter.

Figure 8:
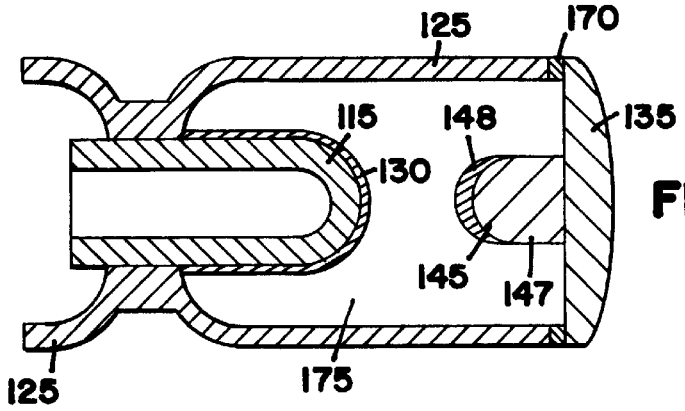
FIG. 8 shows a cross-sectional view of the anode housing assembly attached to an end cap cathode assembly.
Figure 11:
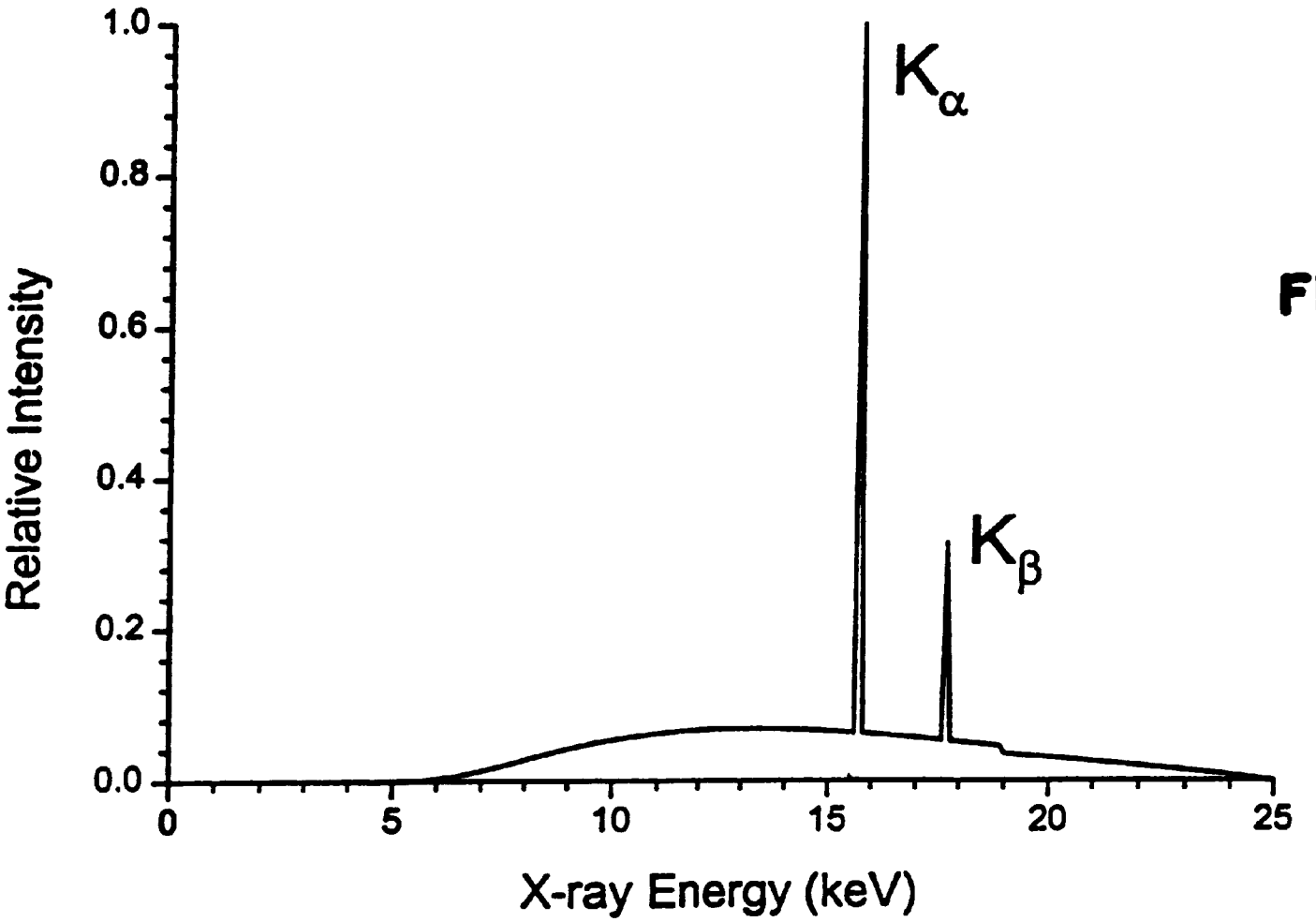
FIG. 11 shows the X-ray spectrum of a zirconium target.

After the CVD process creating the assembly 190 is complete, a vacuum cap 135 that includes a cathode structure 145 can be coupled to the open end of the diamond housing 125 with brazing materials, sealing the vacuum chamber. The vacuum cap 135 is attached to the housing 125 to complete the enclosure of the vacuum chamber 175 as shown in FIG. 8. One attachment method for establishing a vacuum seal is vacuum brazing. Vacuum brazing is known in the art and can be provided by Koral Labs., Fridley, Minn., for example. After the attachment of the vacuum cap 135 to the housing 125 is complete, the anode 115 and cathode 145 may be separated by a vacuum gap about 0.3 mm wide in one embodiment.

In one embodiment the cathode structure 145 comprises a cathode base 147 and a thin diamond film 148 located on a tip of the cathode base 147. Preferably, the cathode base 147 may be a getter and the diamond film could be applied directly to the getter. U.S. Pat. No. 5,854,822, assigned to the assignee of the present application, describes cathode configurations that include a diamond film. U.S. Pat. No. 5,854,822 is incorporated herein by reference in its entirety. The material used for the cathode base depends on how the diamond film is formed. The thin diamond film can be obtained by chemical vapor deposition, as is known in the art. Various materials may serve as an effective substrate for the diamond film synthesis by chemical vapor deposition, such as tungsten, molybdenum, and tantalum. As described more fully below, the diamond film could also be fabricated by other methods, such as by laser ion deposition, making a wider range of materials available for the base of the cathode, such as a getter.

The term diamond film, as used herein, contemplates a coating of carbon having diamond-like bonds which demonstrate negative electron affinity. It is also desirable to have sufficient conductivity to create a constant supply of electrons to the surface of the cathode 145. The presence of some graphite bonds in the diamond film will contribute to conductivity. Thus a combination of a diamond film having both sp3 carbon bonds, to function as a cathode, and some sp2 carbon bonds, to facilitate conductivity, is particularly suited for use in such a system. Other elements may also be present in the film in small quantities. The diamond film will have the property that it can emit electrons at electrical fields greater than or equal to about 20 V/micron. This required electric field is extremely low when compared to that required by metal emitters such as molybdenum or silicon, which require greater than 1,000 V/micron.

If a getter is included as the cathode base 147, the getter may aid in creating and maintaining a vacuum condition of high quality. The getter has an activation temperature, at which it will react with stray gas molecules in the vacuum chamber 175. After the getter is disposed as part of the cathode structure 145 within the vacuum chamber 175 and the housing pumped out and sealed, the device can be repeatedly heated to the activation temperature. It is desirable that the getter used have a minimum activation temperature low enough so that the X-ray device is not damaged when heated to the activation temperature. A SAES ST 101 alloy getter may be used, which has an activation temperature in the range 750 to 900° C. and is composed of approximately 64% zirconium and 16% aluminum. A ST 707 alloy getter could also be used, which has an activation temperature in the range 250 to 900° C. and is composed of approximately 70% zirconium, 24.6% vanadium, and 5.4% iron.

In one embodiment, the cathode base 147 comprises a material that is a mixture of diamond powder and granulated getter material. The diamond getter mixture type cathode is described more fully in U.S. patent application Ser. No. 09/135,904, filed Aug. 18, 1998 and titled "Cathode Using Getter Material," which is incorporated herein by reference in its entirety.

The connections between the components of the X-ray emitter will now be described. After the cathode structure 145 has been vacuum brazed to the vacuum housing 125 and the getter included in the cathode base 147 has been activated, the entire X-ray unit may be coated with a conductive layer 150, such as a titanium layer having a thickness of 0.1 to 1 $\mu$m. The exterior conductive layer 150 can be formed by a variety of techniques, for example, chemical vapor deposition or physical vapor deposition. In another embodiment, a titanium layer over the housing 125 could be itself coated with a layer of nickel and then a layer of gold. Gold provides a preferable outer coating because it does not oxidize and it is easy to work with. The conductive layer 150 is electrically coupled to the cathode base and the external conductive layer of the coaxial cable by conductive solder. Thus, all three elements, the external conductive layer of the coaxial cable, the conductive layer 150 and the cathode 145 can be at a low potential in order to create the potential difference necessary for electron acceleration.

In other embodiments of the invention, as an alternative to metallization of the housing 125, the exterior layers of the diamond housing 125 can be made conductive. For example, the exterior surface of the housing 125 can be made conductive by changing the composition of the reactants during chemical vapor deposition, such as by increasing the methane concentration to form graphite-rich diamond or by doping the exterior layers of the housing surface with boron.

FIG. 1 shows a connector that is preferably a coaxial cable 165. The coaxial cable 165 includes a central core conductor 155 that is connected to the interior surface of the anode 115 by conductive solder 160. The coaxial cable connector 165 also includes an outer conductor 167 for connection to the cathode 145. Within the coaxial cable connector 165, an insulative material 168 may separate the central core conductor 155 from the outer conductor 167. Different types of connectors may also be used to provide high voltage to the X-ray emitter. For example, two wire conductive lines, round or flat wires, could serve as the connector. A connector that is able to hold a voltage at 15–30 kV and above may be used in place of the connector 165.

The anode 115 receives the distal end of a high voltage conductor, such as the core conductor 155 of a coaxial cable in one embodiment. The proximal end of the core conductor 155 of the coaxial cable is connected to a high voltage power supply (not shown). The entire x-ray device 100 may be coated with a biocompatible material if the device is to be used in a body.

A coronary artery after angioplasty typically has a diameter of about 3.0 millimeters. Many other applications require X-ray devices with small diameters. Therefore, a coaxial cable and any covering used in this device for use in coronary arteries preferably has a diameter less than or equal to 3.0 millimeters. The cable must also be able to carry the required voltages and have sufficient flexibility to make numerous turns as it follows the artery path. Standard high voltage coaxial cables are generally not flexible enough. However, miniature high frequency coaxial cables with an outer diameter of approximately 1.0 millimeters to 3.0 millimeters are available which exhibit sufficient flexibility. These cables can hold voltages as high as 50–75 kV without breakdown. Such cables are manufactured by, for example, New England Electric Wire Corporation, Lisbon, N.H.

The outer conductor 167 must be electrically connected to the cathode 145, so that an electric field will be applied across the cathode 145 and the anode 115 causing electrons to be emitted from the cathode 145. The conductive layer 150 is disposed on the outside of the diamond housing 125. The conductive layer 150 is connected to the outer conductor 167 by conductive soldering 172, at the juncture between the proximal end of the diamond housing 125 and the connector 155. The conductive layer 150 is in turn electrically coupled to the cathode 145 by a second area of conductive soldering 170.

At the distal end of the diamond housing 125, a soft distal tip 180 may be utilized to improve maneuverability through a patient lumen. The distal tip may be made of any biocompatible, flexible material, such as polyurethane, polyethylene, or Teflon® material.

A coating of biocompatible material may be applied to the entire X-ray unit, such as polyethylene, polyurethane or Teflon® material. A thickness of less than about 0.002 inches is typical so that the overall outer diameter is not increased significantly.

As noted above, the present invention is applicable to the fabrication of a number of X-ray emitters. Accordingly, the present invention should not be considered limited to the particular examples described above, but rather should be understood to cover all aspects of the invention as fairly set out in the accompanying claims. Various modifications, equivalent processes, as well as numerous structures to which the present invention may be applicable will be readily apparent to those of skill in the art to which the present invention is directed upon review of the present specification. The claims are intended to cover such modifications and devices.

We claim:

1. A device for producing X-ray radiation, comprising:

a housing comprising diamond;

a cathode disposed within the housing;

an anode structure comprising diamond, the anode structure coupled to the housing, the cathode and the anode structure arranged to enable the production of X-ray radiation; and a target metal disposed on the anode structure.

2. The device of claim 1, wherein the target metal has characteristic X-ray emission of at least about eleven kilo-electron volts.

3. The device of claim 1, wherein the target metal is selected to produce X-ray radiation having a depth of penetration with a half-value layer in water of at least about two millimeters.

4. The device of claim 1, wherein the target metal is selected from a group consisting of strontium, yttrium, zirconium, niobium, molybdenum, palladium, silver, tenesium, or combinations thereof.

5. The device of claim 1, wherein the housing comprises an electrically conductive exterior layer.

6. The device of claim 5, wherein the exterior layer comprises a metallic layer.

7. The device of claim 5, wherein the exterior layer comprises diamond doped with boron.

8. The device of claim 5, wherein the exterior layer comprises graphite.

9. The device of claim 1, wherein the housing has a thickness of at least about 150 microns and not more than about 250 microns.

10. A component for an X-ray emitter comprising a housing comprising a diamond coupled to an anode structure comprising conductive diamond; and a target metal disposed on the anode structure.

11. The device of claim 1, wherein the anode structure comprises conductive diamond.

12. The device of claim 1, wherein the anode structure comprises graphite.

13. The device of claim 1, wherein the housing comprises diamond having high resistivity.

* * * * *